United States Patent [19]

Werner et al.

[11] 4,172,563

[45] Oct. 30, 1979

[54] SHUT-OFF UNIT IN A DRIVE UNIT FOR AWNINGS AND ROLLER BLINDS

[75] Inventors: Richard Werner, Pfungstadt-Hahn; Adolf Lindner, Rottendorf; Klaus-Dieter Voigt, Nüremberg, all of Fed. Rep. of Germany

[73] Assignee: Siemens Aktiengesellschaft, Munich, Fed. Rep. of Germany

[21] Appl. No.: 667,544

[22] Filed: Mar. 17, 1976

[30] Foreign Application Priority Data

Mar. 19, 1975 [DE] Fed. Rep. of Germany ..... 2512102

[51] Int. Cl.[2] ..... E06B 9/204; E06B 9/209

[52] U.S. Cl. ..... 242/55; 74/568 T; 160/310; 192/140; 200/61.84; 242/57

[58] Field of Search ..... 192/145, 142, 139, 138; 242/54 R, 57, 55; 160/310; 254/173 R, 174; 200/61.84; 74/568 T

[56] References Cited

U.S. PATENT DOCUMENTS

| | | | |
|---|---|---|---|
| 1,624,261 | 4/1927 | Lilly et al. | 192/139 |
| 1,633,284 | 6/1927 | Owen | 192/139 |
| 1,923,175 | 8/1933 | Stuart | 160/310 X |
| 2,852,630 | 9/1958 | Burrows | 192/139 |
| 3,162,425 | 12/1964 | Babacz | 242/54 R |
| 3,325,609 | 6/1967 | Otterlei | 74/568 T |
| 3,684,244 | 8/1972 | Houch | 192/139 |

FOREIGN PATENT DOCUMENTS

| | | | |
|---|---|---|---|
| 1245064 | 7/1967 | Fed. Rep. of Germany | 160/310 |
| 360305 | 3/1962 | Switzerland | 160/310 |
| 1192757 | 5/1970 | United Kingdom | 200/61.84 |

*Primary Examiner*—George F. Mautz

*Attorney, Agent, or Firm*—Kenyon & Kenyon

[57] ABSTRACT

A shut-off unit is disclosed. The shut-off unit is to be used to shut off a drive unit which drives a tubular shaft, the latter shaft being employed, in turn, to wind an awning or a roller blind up and down. More particularly, the drive unit includes an electric motor and a step down gear drive axially aligned therewith and the shut-off unit is adapted to be arrangeable in the drive unit so that the step down gear lies between it and the motor. Additionally, the shut-off unit includes switches for stopping the drive and members for operating such switches which have presettable positions dependent upon presettable positions of a driven part of the electric motor. In accordance with the invention, the aforesaid members are in the form of cams which have lobes and which are adapted to rotate as a function of the movement of the element to be wound and to be drivingly connectable to the central output shaft of the step down gear.

With such an arrangement for the drive unit it can have shorter mounting dimensions and can be driven directly by the centrally disposed step down gear.

17 Claims, 2 Drawing Figures

SHUT-OFF UNIT IN A DRIVE UNIT FOR AWNINGS AND ROLLER BLINDS

BACKGROUND OF THE INVENTION

1. Field of the Invention

This invention relates to a shut-off unit for stopping a drive unit which is to drive a tubular shaft upon which is to be wound an awning or a roller blind.

2. Description of the Prior Art

Shut-off units of the above type are typically required to stop the drive unit in at least two defined end positions corresponding to the desired end positions of the element being wound. In one particular type of known shut-off unit, the unit is adapted to be arranged at a first end of a drive unit of a type which is additionally comprised of the following individual elements arranged axially one behind the other proceeding in a direction away from the shut-off unit: a capacitor, an electric brake, an electric motor, a step down gear and an output shaft. More specifically, this known type of shut-off unit comprises a so-called spindle drive in which spindles are driven via an internal gear which is in engagement with the tubular shaft being driven by the drive unit. Carried on the spindles are lobes which are moved axially and which actuate end switches for switching off the drive unit when the desired end positions are reached.

It is object of the present invention to provide a shut-off unit of the above type which has shorter mounting dimensions, is easy to install and is operationally reliable.

SUMMARY OF THE INVENTION

In accordance with the principles of the present invention, the above and other objectives are accomplished in a shut-off unit of the above type by adapting the unit such that it can be arranged in the drive unit so that the step down gear lies between it and the motor and by including in the shut-off unit cams which have lobes for actuating switches which are adapted to stop the drive unit. More particularly, the cams are adapted to be drivingly connectable to the central shaft of the step down gear. As a result, they undergo rotation which is related to the rotation of the tubular shaft being driven by the drive unit and, thus, the movement of the element being wound thereon.

With this configuration for the shut-off unit, the unit can now be placed in the drive unit directly adjacent the step down gear. Additionally, the length of the shut-off unit and, thus, the entire drive unit is significantly reduced, as is also the danger of major damage if, due to some disturbance, the drive unit is not stopped upon reaching the pre-settable end positions (switch failure).

Advantageously, the shut-off unit is additionally provided with a reduction gear which is drivingly connected to the cams of the unit and which is adapted to be drivingly connectable to the step down gear of the drive unit. More specifically, the reduction gear is designed to have a step down ratio such that it causes, at maximum, a single revolution of the cams in response to the revolutions of the central shaft of the step down gear and, hence, to the revolutions of the tubular shaft driven thereby, corresponding to the travel of the element to be wound between two settable end positions. Moreover, to facilitate operation of the cams and to permit one-time adjustment thereof, the shut-off unit is further provided with a drive disk which is coupled with the output shaft of the reduction gear and against which the cams are pressed in the sense of a, preferably, tight-fitting friction drive. With the cams driven in this manner, the circumferential distance between the lobes corresponds to the distance moved by the cams during the revolutions made by the tubular shaft in moving the element being wound between the two settable positions.

In order to be able to adjust the cams so as to realize the latter, the shut-off unit is provided with adjusting pins for setting the position of the cams relative to the drive disk and to each other. More particularly, each adjusting pin is provided with a conical or tapered end which can be pressed against a flank of its associated cam to temporarily lift the force-transmitting drive, preferably established by means of a spring force, between the cam and the drive disk. The conical end of each adjusting pin is, preferably, provided with teeth, which engage with corresponding unilateral teeth on the flank of the respective cam when the adjusting pin is pressed in.

A compact and at the same time simple configuration for the reduction gear drive can be realized by designing the gear as a multi-stage unit and by providing that the corresponding gears are arranged, alternatingly, on a rotatable shaft portion forming an extension of the central shaft of the step down gear and on a stationary shaft. In particular, the last gear of the drive is disposed on the stationary shaft and is coupled with the drive disk which is also rotatably disposed on the same shaft. On the other hand, the first gear of the drive is clamped to the extended central shaft portion, and the other remaining gears are rotatably disposed on the extended shaft portion and the stationary shaft, respectively.

BRIEF DESCRIPTION OF THE DRAWINGS

The above and other features and aspects of the present invention will become apparent upon reading the following detailed description in conjunction with the accompanying drawins, in which.

DETAILED DESCRIPTION

Figure 1:
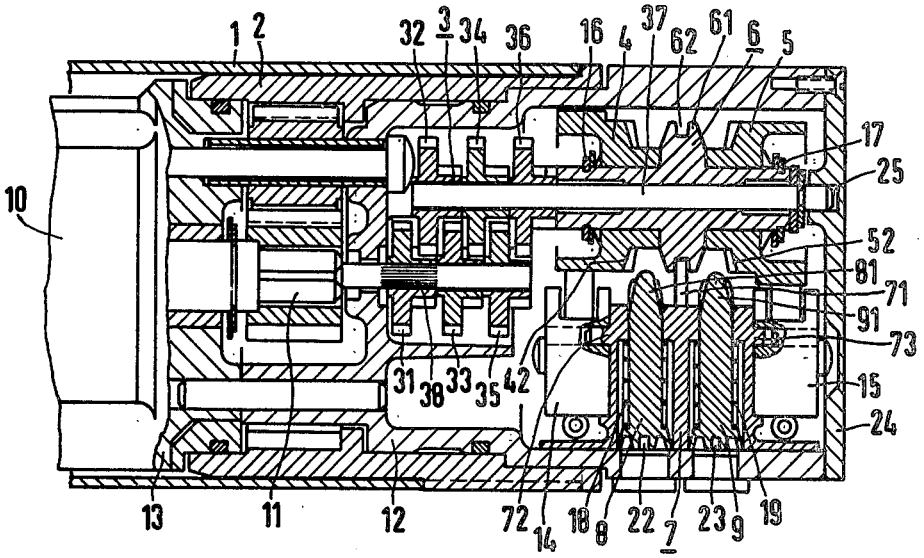
FIG. 1 shows a partial longitudinal cross section of a drive unit inserted into a tubular shaft and employing a shut-off unit in accordance with the principles of the present invention.
Figure 2:
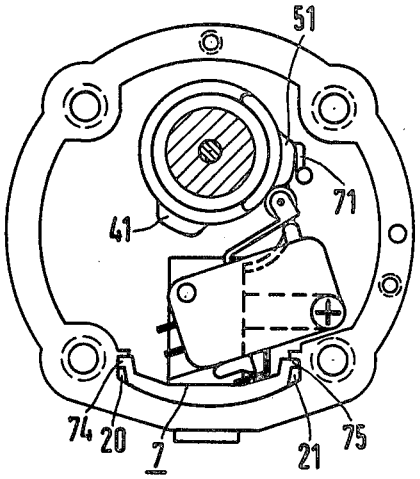
FIG. 2 is a view along the axis of the drive unit, with the cover of the unit removed, thereby allowing observation of the frontal portion of the shut-off unit.

FIG. 1 shows a drive unit comprising a shut-off unit designed in accordance with the principles of the present invention. The drive unit is housed in a tubular shaft 1 which it is to drive and upon which can be supported an element to be wound. In FIG. 1 only the shut-off unit, step down gear drive comprised of planetary drive 10 and spur gear drive 11 having a central shaft 38, of the drive unit are specifically illustrated. The drive unit additionally includes a capacitor and an electric motor with an integrated sliding-armature brake which precede the planetary gear 10. Torque is transmitted from the electric motor to the tubular shaft 1 via the planetary drive 10, the spur gear drive 11 and an internally geared hollow wheel 2 which is driven by the gear 11, and which, at its right-hand outer end, has projections which engage corresponding slots of the tubular shaft 1.

The gear drive housing of the drive unit is divided into two parts. A first housing part 12 includes the gear drive 11, the reduction gear 3 and the integrated shut-off unit. A second housing part 13 includes, among other things, the planetary drive 10.

As indicated, the shut-off unit portion of the housing part 12 extends outwardly from the right-hand end of the tubular shaft 1 and is provided on its lower side with openings, into which adjusting pins 8, 9 are inserted. The latter pins are used to set the shut-off unit so it stops the drive unit at pre-settable end positions of the element being wound.

As can be seen, the reduction gear 3 is interposed between the shut-off unit and the central output shaft 38 of the step down gear drive 10, 11. More particularly, the reduction gear 3 is of a multi-stage design and comprises gears 31 to 36. The latter are alternately arranged on a rotatable extended shaft portion of the central shaft 38 of the spur gear drive 11 and on a stationary shaft 37. The first gear 31 of the reduction gear drive 3 is clamped on the central shaft 38, while the gears 33, 35 are rotatably disposed on the same shaft. The gears 32, 34, 36, on the other hand, are rotatably fixed to shaft 37.

The last gear 36 of reduction gear 3 is tightly coupled to a drive disk 6 which forms part of the shut-off unit. The disk 6 is also rotatably disposed on the stationary shaft 37. The shut-off unit further includes cams 4, 5 which are arranged on both sides of the disk 6 and are pressed against the disk so as to be in frictional engagement therewith by means of springs 16, 17. The two cams 4 and 5 are advantageously provided with lobes which are associated with and actuate the end switches 14 and 15, respectively of the shut-off unit. Additionally, the cams are adjusted such that the circumferential distance between their respective lobes corresponds to the number of revolutions of the central shaft of gear 11 and, thus, of shaft 1 which are associated with the maximum travel between two pre-settable end positions desired of the material being wound on the latter shaft. To permit such adjustment, the step down ratio of the reduction gear 3 is selected such that it causes, at a maximum, a single revolution of the cams in response to the revolutions of the tubular shaft corresponding to such maximum travel.

As indicated above, the position of the cams 4, 5 relative to disk 6 and to each other can be adjusted via the pair of adjusting pins 8, 9. To facilitate such adjustment, the adjusting pins 8, 9 are provided with conical ends 81, 91, which can be pressed against corresponding flanks 42, 52 of their associated cams 4 and 5. In this manner, an adjusting torque can be applied to lift the force-transmitting drive between the cams 4, 5 and the drive disk 6 which is being effected by the springs 16, 17. In particular, this is accomplished by pushing the adjusting pins 8, 9 against the springs 18, 19 in the direction toward the cams 4, 5. By turning of the adjusting pins 8, 9, the cams can be continuously changed in their position relative to the drive disk 6. To further aid such movement, the conical ends 81 and 91 are, advantageously, provided with teeth, which engage with corresponding unilateral teeth on the flanks 42, 52 of the respective cams 4, 5 when the adjusting pins 8, 9 are pressed in.

Also advantageously, the drive disk 6 and the cams 4, 5 are arranged on the stationary shaft 37 so they can be moved by a small amount in such a manner that the teeth of the adjusting pins 8, 9 can be brought into engagement with the teeth of the cams 4, 5 in a self-centering manner. In particular, this is realized by forming the drive disk 6 so it has a conical outer rim 61, the outer surface of which forms with the respective flanks 42, 52 of the cams 4, 5 lead-in funnels for the adjusting pins 8, 9. At its radially inner portion, the drive disk 6 is of cylindrical design which permits, as above-noted, frictional driving of the cams 4, 5.

In the illustrative embodiment shown, a guide lever 71 is attached to the mounting base 7 which supports the pins 8 and 9. The lever 71 can be resiliently snapped into a guide groove 62 in the drive disk 6 so as to precenter the axially movable drive disk 6 and the mounting base 7.

To further facilitate assembly of the shut-off unit, the mounting base 7 is adapted to be axially guided into the first housing part 12 surrounding the shut-off unit and to be secured in the former in a positively force-transmitting manner. More particularly, the mounting base 7 is provided with elastic projections 74, 75 which press against corresponding guide ribs 20, 21 at the inner wall of the first housing part 12. Also, advantageously the mounting base 7, which is also provided with guides 76, 77 for the adjusting pins 8, 9 as well as with mounting means 72, 73 for the end switches 14, 15, can be made of a one-part plastic part.

In the assembly of the shut-off unit, the drive disk 6 together with the cams 4 and 5, on the one hand, and the mounting base with the assembled components, on the other hand, can each be inserted as separate assemblies. In such case, the resilient guide lever 71 is slightly bent over by the guide groove 62 of the drive disk and subsequently snaps in to the guide groove after the two assemblies are put in place. Automatic precentering of the two assemblies with respect to each other thereby results.

The adjusting pins 8, 9 are advantageously provided with elastic undercuts 22, 23 in such a manner that the adjusting pins 8, 9 and the undercuts can be inserted through openings of the first housing part 12 outside the outer end of the tubular shaft 1 against the spring force of the springs 18, 19 and subsequently secured in the direction opposite to that of the insertion by the fact that the undercuts 22, 23 rest against the inside surface of the first housing part 12.

To permit checking the shut-off unit and observation of the end portions preset by the cam positions, the shut-off unit is closed off at its axially disposed outer end, situated outside the tubular shaft, by a transparent cover 24. Advantageously, a bearing receptacle 25 for the stationary shaft 37 of the reduction gear 3 is simultaneously formed on the inside of the transparent cover 24.

What is claimed is:

1. A shut-off unit for use in stopping a drive unit which drives a tubular shaft upon which an element is to be wound, the drive unit being of a type including an electric motor and a step down gear drive having a central shaft and being drivingly connected to said motor, said drive unit being adapted to be contained within the tubular shaft, the shut-off unit being adapted to be arrangeable such that the step down gear drive is disposed between the shut-off unit and the motor, the shut-off unit comprising:

switches for stopping said drive unit;

means adapted to actuate said switches in accordance with a pre-settable number of rotations of said central shaft of said step down gear drive, said pre-settable number being dependent upon pre-settable end positions of the element to be wound, said means including cams which have lobes and which are adapted to be drivingly connectable to said central shaft of said step down gear drive, whereby said cams are adapted to undergo rotation which is related to the rotation of said central shaft, and therefore, the end positions of said element to be wound; and means for coupling said cams to said central shaft of said step down gear drive comprising:

i. a drive disk mounted on a stationary shaft, means coupling said drive disk to said central shaft;

ii. means releasably pressing said cams against opposite sides of said drive disk to obtain a frictional drive therebetween; and iii. two adjusting pins mounted for radial movement with respect to said drive disk adapted to engage said cams to release them from engagement with said disk to permit adjusting said cams by rotation on said stationary shaft.

2. A shutoff unit in accordance with claim 1, wherein said means coupling said drive disk to said central shaft includes a reduction gear.

3. A shut-off unit in accordance with claim 2 in which the step down ratio of said reduction gear is selected such that said reduction gear is adapted to cause at maximum a single rotation of said cams during said pre-settable number of rotations of said central shaft.

4. A shut-off unit in accordance with claim 1 in which:

said cams are adjusted such that the circumferential distance between the lobes thereof corresponds to said presettable number of rotations of said central shaft.

5. A shut-off unit in accordance with claim 1 wherein said adjusting pins have conical ends and wherein said cams contain flanks adapted to be engaged by said conical ends, whereby said pins can be radially moved so that their conical ends press against said flanks lifting the frictional drive between said cams and said disks, permitting an adjusting torque to be transmitted to said cams.

6. A shut-off unit in accordance with claim 5 in which:

said flanks of said cams have unilateral teeth;

and said conical ends of said pins have teeth for engaging said teeth of said flanks.

7. A shut-off unit in accordance with claim 6 in which:

said disk has a conical outer rim whose outer surface forms with the flanks of said cams a lead-in funnel for causing said adjusting pins to be brought into contact with said cams in a self-centering manner.

8. A shut-off unit in accordance with claim 7 in which:

said disk has a circumferential guide groove;

and said mounting base includes a guide lever resiliently snapped into said groove, thereby permitting self centering of said disk with said mounting base.

9. A shut-off unit in accordance with claim 6, wherein: said drive disk is supported on said stationary shaft which is coupled to said central shaft so as to be axially moveable by a small amount; said cams are supported on said drive disk and thus capable of axial movement therewith; and said shut-off unit further includes a mounting base supporting said pins, whereby said pins can be brought into engagement with the teeth of said cams in a self-centering manner due to the ability of said drive disk to execute a small amount of axial movement.

10. A shut-off unit in accordance with claim 9, and further including:

(a) a housing surrounding said shut-off unit; and (b) said mounting base axially inserted into said housing, and secured therein in a force transmitting manner.

11. A shut-off unit in accordance with claim 9, wherein said mounting base comprises a one-piece plastic part having thereon mounting means for said switches and guides for guiding said pins.

12. A shut-off unit in accordance with claim 1 in which said adjusting pins include:

elastic undercuts adapted to permit said pins to be insertable in an opening of a housing part surrounding said shut-off unit against a spring force and to be securable in directions opposite the direction of insertion by resting on the inside surface of said housing part.

13. A shut-off unit in accordance with claim 2 in which said reduction gear is of a multi-stage design and includes:

a first extended portion forming part of said stationary shaft;

a second extended shaft portion forming part of said central shaft of said step down gear drive;

and a number of drive gears alternately arranged on said first and second extended shaft portions.

14. A shut-off unit in accordance with claim 13 in which the first gear of said number of gears is clamped on said second extended shaft portion and the remaining gears of said number of gears are rotatably disposed on their respective shaft portions.

15. A shut-off unit in accordance with claim 13 in which:

said last drive gear on said first extended shaft portion is coupled to said drive disk.

16. A shut-off unit in accordance with claim 14 which further includes:

a transparent cover for closing off the outer end of said shut-off unit, said cover having a bearing receptacle for said stationary shaft.

17. A shut-off unit in accordance with claim 1 which further includes:

a transparent cover for closing off the outer end of said shut-off unit.

* * * * *